US008336533B2

(12) United States Patent
Bach et al.

(10) Patent No.: US 8,336,533 B2
(45) Date of Patent: Dec. 25, 2012

(54) BOWSTRING VIBRATION DAMPENERS AND SIGHTS

(75) Inventors: Jon C. Bach, Frenchtown, NJ (US); Richard S. Chomik, Doylestown, PA (US)

(73) Assignee: Accuracy In Motion Outdoors LLP, Hampton, NJ (US)

( * ) Notice: Subject to any disclaimer, the term of this patent is extended or adjusted under 35 U.S.C. 154(b) by 57 days.

(21) Appl. No.: 12/984,314

(22) Filed: Jan. 4, 2011

(65) Prior Publication Data

US 2011/0265778 A1 Nov. 3, 2011

Related U.S. Application Data

(63) Continuation-in-part of application No. 12/369,618, filed on Feb. 11, 2009.

(60) Provisional application No. 61/027,785, filed on Feb. 11, 2008.

(51) Int. Cl.
*F41B 5/00* (2006.01)
*F41G 1/467* (2006.01)

(52) U.S. Cl. ..... 124/92; 124/87

(58) Field of Classification Search ..... 124/87, 124/89, 90, 91, 92

See application file for complete search history.

(56) References Cited

U.S. PATENT DOCUMENTS

| | | | | | |
|---|---|---|---|---|---|
| 295,252 | A * | 3/1884 | Hutchins | 24/114.5 |
| 2,023,438 | A * | 12/1935 | Ray | 492/56 |
| 2,773,300 | A * | 12/1956 | Clements | 492/16 |
| 3,410,644 | A * | 11/1968 | McLendon | 356/247 |
| 3,584,615 | A * | 6/1971 | Stinson | 124/92 |
| 3,703,771 | A * | 11/1972 | Saunders | 33/265 |
| 4,011,853 | A * | 3/1977 | Fletcher | 124/87 |
| 4,656,747 | A * | 4/1987 | Troncoso | 33/265 |
| 4,965,938 | A * | 10/1990 | Saunders | 33/265 |
| 5,287,842 | A * | 2/1994 | Saunders | 124/91 |
| 5,347,976 | A * | 9/1994 | Saunders | 124/87 |
| 5,542,186 | A * | 8/1996 | Saunders | 33/265 |
| 5,669,146 | A * | 9/1997 | Beutler | 33/265 |
| 5,860,408 | A * | 1/1999 | Summers | 124/87 |
| 5,996,569 | A * | 12/1999 | Wilson | 124/87 |
| RE36,555 | E * | 2/2000 | Tentler | 124/91 |
| 6,131,295 | A * | 10/2000 | Cranston | 33/265 |
| 6,343,600 | B1 * | 2/2002 | Steinman | 124/91 |
| 6,761,158 | B2 * | 7/2004 | Wright | 124/92 |
| 7,275,327 | B2 * | 10/2007 | Deien | 33/265 |

* cited by examiner

*Primary Examiner* — John Ricci
(74) *Attorney, Agent, or Firm* — Kelley, Drye & Warren LLP

(57) ABSTRACT

Archery bow string dampers and peep sights comprised of a rigid ellipsoidal inner core and an elastomeric outer surface are disclosed.

9 Claims, 9 Drawing Sheets

BOWSTRING VIBRATION DAMPENERS AND SIGHTS

This patent application is a continuation-in-part application of co-pending U.S. patent application Ser. No. 12/369,618, filed on Feb. 11, 2009, which claims benefit of U.S. Provisional Application Ser. No. 61/027,785, filed Feb. 11, 2008, the entire content of which is incorporated herein in its entirety.

BACKGROUND OF THE INVENTION

1. Field of the Invention

The present invention generally relates to archery vibration dampening systems and sighting systems. In one non-limiting embodiment an improved peep sights that integrally provides vibration dampening or silencing capability as well as sighting ability is disclosed.

2. Description of the Related Art

Archery peep sights are devices that mount onto a bowstring in order to improve sighting and aiming ability (see FIG. 1, peep sight 28). A peep sight is used analogously to the rear sight of a rifle, in that it creates a viewing line from the archer's eye to a forward sighting point used for aiming. Archers and hunters have long used peep sights on their bows to improve sighting and aiming.

Vibration dampeners may also be mounted on a bowstring by archers to reduce noise and other effects following a bowstring stroke (see FIG. 1, vibration dampener 26). A bowstring dampener, also known as bowstring silencer, reduces audible and inaudible oscillations in a bowstring after the arrow is released in a shooting stroke. The noise reduction is accomplished by transferring some of the remaining vibratory energy into the nodules and protrusions that are part of the string silencer. The transferred energy causes the nodules and protrusions to mechanically deform and oscillate thereby dissipating the remaining energy. An example of a conventional string silencer, fabricated from elastometric material, may be found in U.S. Pat. No. 6,237,584.

FIG. 2 shows an example of a conventional bowstring-mounted peep sight 28 in expanded size, and FIG. 3 further details an example of a conventional bowstring dampener 26, fabricated of an elastometric material, in expanded size.

The following United States patents are relevant to archery peep sights: Hutchins, in U.S. Pat. No. 295,252, discloses a stop comprising two adjoining hemispherical shells for attaching the stop to check-row wires.

McLendon, in U.S. Pat. No. 3,410,644, teaches a telescopic means for a bow wherein the target is magnified.

In U.S. Pat. No. 3,703,771 discloses an archery peep sight adapted for securement on a stranded bowstring.

Inventor Troncoso, in U.S. Pat. No. 4,656,747, teaches a bowstring peep sight that can be easily and securely connected to the bowstring of a compound or non-compound bow.

Saunders, in U.S. Pat. No. 4,965,938, teaches a peep sight for mounting on the bowstring of an archery bow. The peep sight is resistively and frictionally stably mounted on and coupled to the bowstring, yet readily, manually relocatable at selected positions along the bowstring.

In U.S. Pat. No. 5,542,186 is disclosed a peep sight device for mounting on the bowstring of an archery bow. The device is characterized in that it includes a skeletal ring and an interiorly-mounted transversely-extending frame. The frame demarks and defines a peep sight orifice.

U.S. Pat. No. 5,669,146 discloses a rear peep sight for use with an archery bow that has a sighting body with front and rear surfaces joined by a side surface and a mounting groove formed in the side surface for retaining the sighting body on a bowstring. A sighting aperture and a plurality of locator apertures extend from the rear surface to a bottom surface of a cavity in the sighting body.

U.S. Pat. No. 5,860,408 discloses a peep sight device for a bowstring includes a pair of interengaged inner and outer sections, with a sight hole surrounded by a peripheral surface having a degree of taper such that substantially about 120° of natural light is available to the sight hole on each of two opposite sides of the device.

U.S. Pat. No. 5,996,569, teaches a bowstring mounted rear peep sight comprising a transparent material, preferably acrylic.

U.S. Pat. No. 6,131,295 describes a rear sight that is adapted to be mounted on the bowstring of an archery bow having a front sight mounted on the bow. The rear sight includes a body adapted to be mounted on the string in a region which will generally be aligned with the user's eye when the string is drawn.

In U.S. Pat. No. 7,275,327 is described a bow sight system including a bow sight assembly adjustably mounted to a base plate. The bow sight can include a conventional forward sight, such as a pin sight and a V shaped rear sight. Sighting through the V shaped rear sight groove allows the archer to see the forward sight if the bow and archer are in proper alignment.

In summary, these patents, each of which is incorporated by reference, describe a variety of peep sights, varying means of mounting peep sights, and means of sighting bows. None of these patents addresses vibration dampening as an improvement to the peep sight construction.

The need to dampen the vibrations in a bowstring upon firing has been a problem that bow shooters have contended with throughout the history of archery. Excessive vibrations can affect a bow's performance and create additional unwanted noise, and it is understood that such noise may make alert or frighten an animal target. To date this problem has been addressed by adding dampening devices that mount onto the bowstring, such as that shown FIG. 1 and FIG. 3, as a further accessory to a peep sight. Unfortunately the mounting of such accessories onto a bowstring reduces the net arrow speed because of the increased inertial mass of the bowstring and because of air-frictional losses created by the extra devices during a shot.

Even after many centuries of using archery peep sights, no one has heretofore combined the functions of dampening and sighting in one sight. It is believed that this failure was in part due to the lack of suitable materials of fabrication. However, the combination has recently become feasible because of the availability of advanced polymeric materials, that have now been novelly combined, as shown below, with new plastic processing and injection technologies such as "two shot molding" and "insert molding".

In contrast to a conventional bow, a crossbow typically provides an aiming sight separated from the bowstring. Crossbows typically operate with much higher string tensions as compared to conventional compound or recurve bows. A common problem associated with the use of a string silencer with a crossbow, aggravated by the higher string tension, is the cutting of the string silencer by the crossbow string thereby damaging and compromising the performance of the silencer.

SUMMARY OF THE INVENTION

Disclosed in exemplary and non-limiting embodiments described herein are improved string silencers and peep sight devices that provide sighting and vibration dampening features. Peep sights, integrated with string silencers, when used with conventional bows, allow the archer to reduce the total number of devices mounted onto a bowstring and to reduce the resulting loss in arrow speed caused by lower bowstring speed. As with the vibration dampening devices, peep sights can also reduce the net arrow speed due to losses created by the peep sight.

By combining in one embodiment of the instant invention, for use with conventional bows, the functionalities of dampening and sighting, fewer devices are needed on the bowstring. The combination reduces the net loss in arrow speed caused by extra devices mounted onto the bowstring, partly by reducing air friction, and partly by reducing the inertial mass of the combined device, compared to the uncombined accessories. Also, such an embodiment in part utilizes advantageously the surface friction achieved by placing a bowstring in direct contact with an elastomeric rubber surface to partly effect dampening and absorbtion of mechanical energy of the string.

In one non-limiting embodiment there is disclosed a mechanical assembly attached to a bowstring of a conventional bow, that comprises integrally a sighting means for aiming a bow and a dampening means for dampening vibrations of the bowstring and bow after an arrow is discharged from the bow.

In alternative embodiments there are presented bowstring silencers suitable for use where integrated sighting means are not required.

These and other aspects of the invention are described in greater detail below in FIG. 4A and FIG. 4B.

In embodiments, there is presented an archery bow string silencer comprising: a rigid inner core portion, formed of a first material, that comprises a plurality of prominent inner longitudinal ribs; a less-rigid outer portion, formed of a second material, bonded to the rigid inner core portion, the less-rigid outer portion comprising inner longitudinal channels, formed by a plurality of prominent outer longitudinal ribs, the prominent outer longitudinal ribs comprising latitudinal interruptions thereby forming multiple flexible nodules.

BRIEF DESCRIPTIONS OF DRAWINGS

FIGS. 1-3 are intended to assist in illustrating and defining conventional bow, dampener, and peep sight technologies.

FIG. 1 provides in perspective view one example of a conventional compound bow with peep site and dampener both mounted on the bowstring (or shooting string).

FIG. 2 illustrates in an expanded perspective view a conventional peep sight mounted or clamped on a bowstring.

FIG. 3 provides in expanded perspective view a conventional bowstring dampener.

FIG. 4A discloses in perspective view an exemplary embodiment of the instant invention, integrally combining peep site and dampener means.

FIG. 4B shows the embodiment of FIG. 4A in sectional view.

FIG. 5A provides in perspective view an exemplary embodiment of the invention.

FIG. 5B provides in perspective side view the exemplary embodiment of FIG. 5A, of the invention.

FIG. 5C provides in perspective a bottom or top view the exemplary embodiment of FIG. 5A, of the invention (as it might be mounted on a bowstring).

FIG. 5D provides in perspective side view the exemplary embodiment of FIG. 5A.

DETAILED DESCRIPTION OF THE INVENTION

The term as used herein, "peep sight" is a rear sight for a bow, attached to the bowstring, similar to a rear sight on a gun, having a small hole through which to sight when aiming the bow.

A recurve bow is a bow that has tips that curve away from the archer when the bow is unstrung.

A compound bow is a modern bow that uses a levering system, usually of cables and pulleys, to bend the limbs of the bow.

A longbow is a type of bow that is tall (roughly equal to the height of a person who uses it), is not significantly recurved, and has relatively narrow limbs.

A crossbow comprises a bow fixed transversely on a stock having a trigger mechanism to release the bowstring, and may incorporate a mechanism for bending the bow.

The term "durometer" refers to a standard indenter device for measuring the hardness of a material as measured by resistance to permanent indentation. The term durometer is often used to refer to the measurement, as well as the instrument itself. The "Shore A" scale of relative hardness is the measurement obtained using the ASTM D2240 type A scale, that is adapted to softer plastics, whereby a measurement of 100 refers to no penetration of the test object by the indenter and a value of 0 refers to a penetration of 2.5 mm or greater into the test object.

The term "dampener" refers to a device that dampens or lessens the vibrations in a bowstring.

The term "elastomeric rubber" or "elastomer" or "elastomeric material" refers to any of various polymers or substances having the elastic properties of natural rubber that typically can be stretched many times at room temperature while returning to their original shapes after stretching is halted. Two such examples of useful, commercially available elastomers are Versaflex® and Dynaflex®. One such specific example of an Versaflex elastomer is Versaflex® CL2242, possessing a Shore hardness (at 10 second delay) of 42 A as measured by a durometer.

A propylene homopolymer is a polymer constructed by chemically linking propylene monomers. One such specific exemplary commercial polymer, useful in the invention, is OnForce™ LFT PP-40 LGF/000 Natural.

Figure 1:
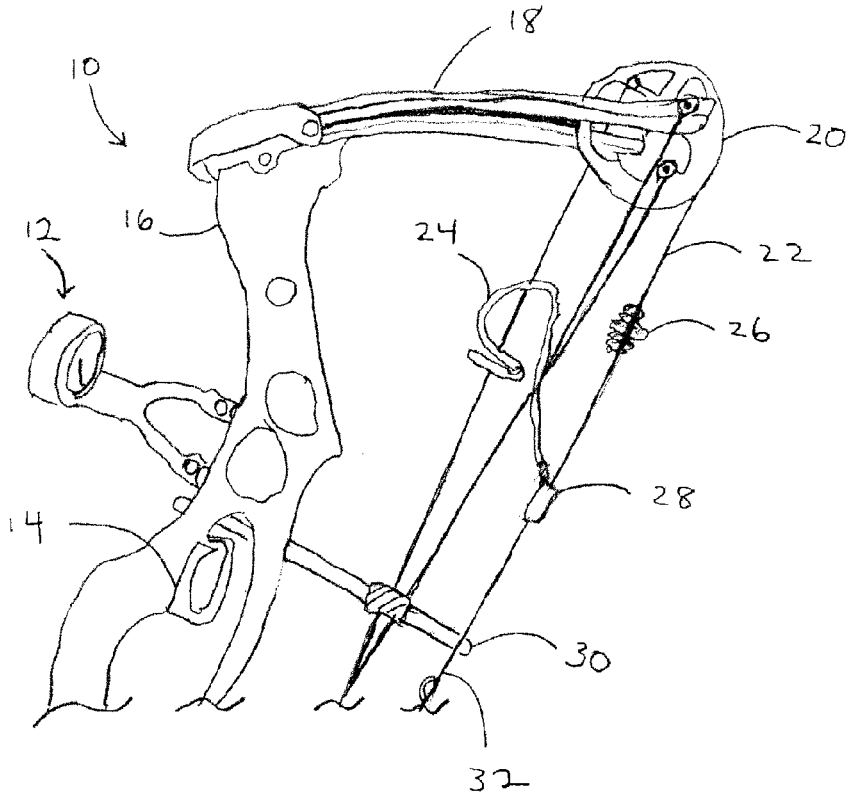
PRIOR ART FIG. 1
Figure 2:
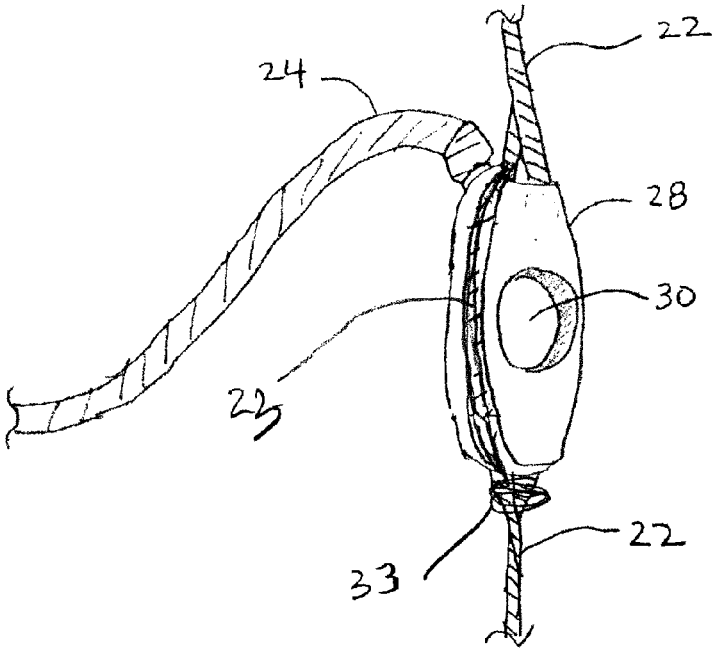
PRIOR ART FIG. 2
Figure 3:
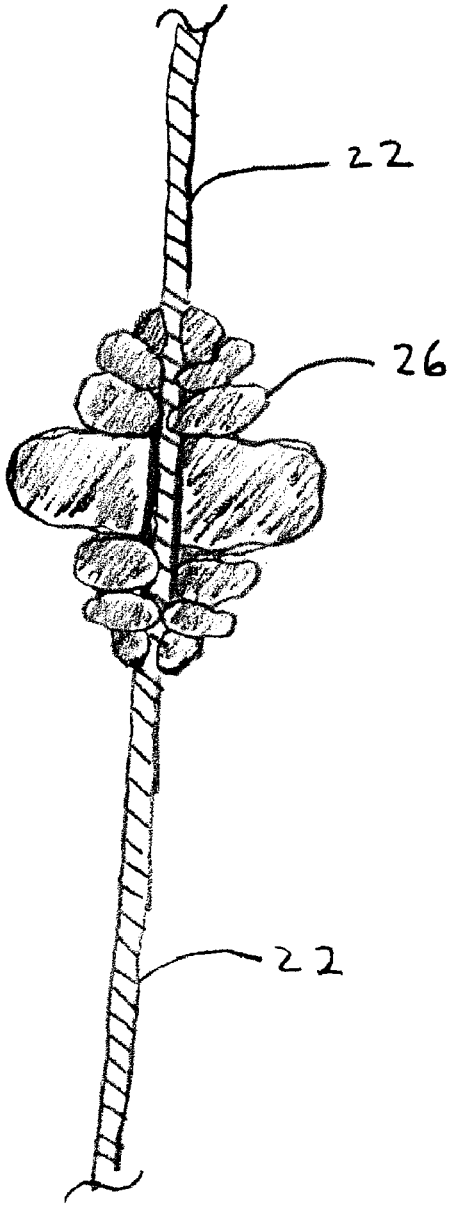
PRIOR ART FIG. 3

Examples of prior art are demonstrated in FIGS. 1-3. Displayed in FIG. 1 is the upper segment 10 of a compound bow assembly, with front sight 12, arrow rest 14, riser 16, upper limb 18, cam assembly 20, bowstring 22, optional peep sight stabilizer 24, dampener 26, peep sight 28, cable guard 30, and nock point 32.

FIG. 2 illustrates in larger view a conventional peep sight 28 mounted between the strands of bowstring 22, with peep sight stabilizer 24 attached to peep sight 28. Annular opening 30 is the opening through which an archer sights through to front sight 12 toward a target. Peep sight serving 33, wrapped around the bowstring, stabilizes the peep sight on bowstring 22.

FIG. 3 illustrates in expanded view a conventional string vibration dampener 26 attached via a clamping fit to bowstring 22.

Figure 4A:
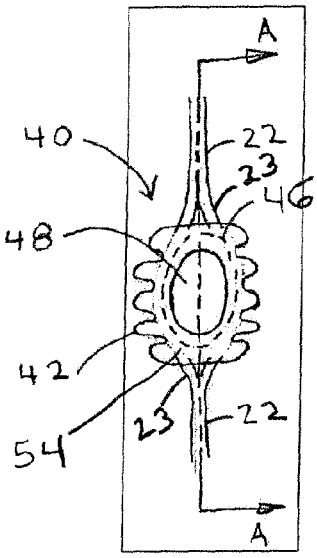
Figure 4B:
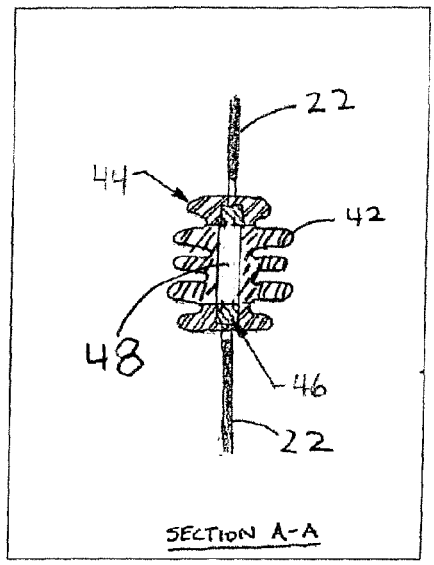
Figure 5A:
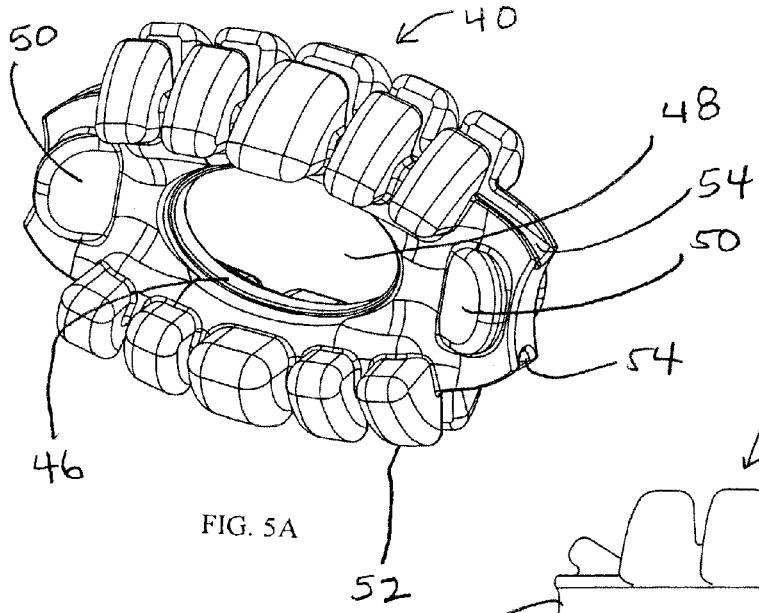
Figure 5B:
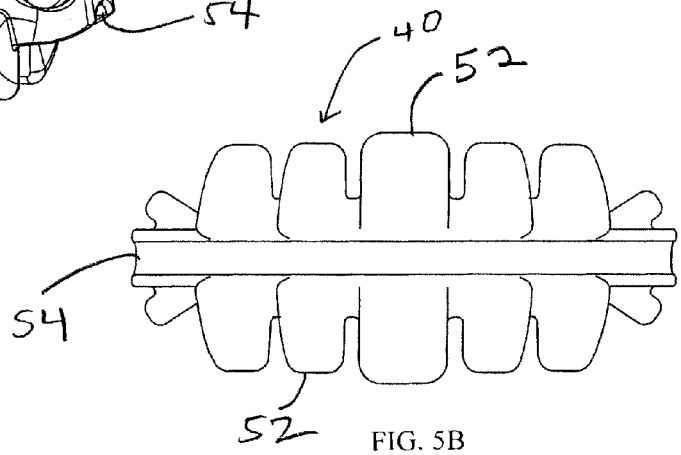
Figure 5C:
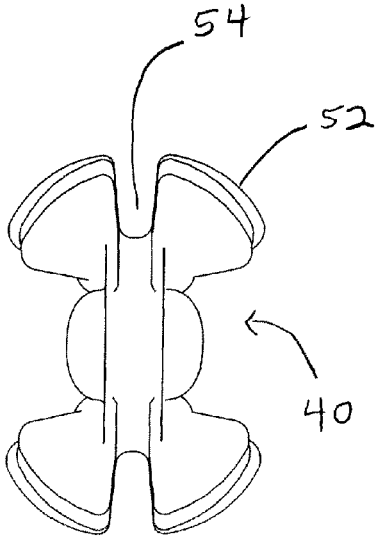
Figure 5D:
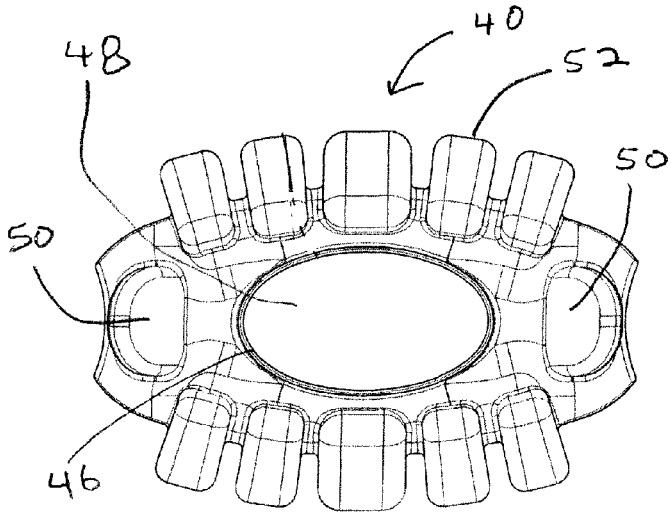

Shown in FIG. 4A, FIG. 4B, and FIGS. 5A-5D are examples of the instant invention. As such, the example in FIG. 4A and 4B provides in one non-limiting embodiment an integrally constructed peep sight and string dampener. The embodiment comprises a rigid peep sight ring 46, constructed with a rigid plastic, such as a propylene homopolymer, with elastomeric rubber material 42, conveniently shaped, to provide the dual function of sighting and vibration dampening within the peep sight. The dampening action is partly due to the favorable rheological properties of the materials used to construct the peep sight, and the favorably allowed mechanical deformations of the elastomeric materials thereof.

FIG. 4A provides a front view of an embodiment of the device, an assembly 40, attached to a bowstring 22 by mounting between the bowstring strands, 23. Rigid ring 46, incorporated into the body of the elastomeric rubber 42, separates and is held in place by the separated strands of the bowstring. The function of rigid ring 46 is to maintain the annular opening 48 in its intended shape against the compressive forces applied by the bowstring. The bowstring may be divided and pass through channels 54. The rigid ring is constructed, for example, from a polypropylene homopolymer.

The archer sights roughly perpendicularly through the annular opening 48 toward the target through the front sight. In the case that 48 is oval, with its long axis vertical, 48 assumes a circular appearance from the archer's perspective as the bowstring is pulled back. FIG. 4B is a cross sectional view of 40 along section A-A. In this sectional view there is again shown a rigid ring 46, which fits between the bowstring strands and creates an opening 48 through which a shooter can sight a target when aligning with a front sight. Attached to the rigid ring is an elastomeric rubber material, 42, of mass, shape, and rheological properties to provide in part the degree of dampening that is needed. This material can be bonded to the rigid ring by any means including mechanical, thermal and chemical.

FIG. 5 illustrates another exemplary embodiment of the invention. FIG. 5A again illustrates an assembly 40, with sighting opening 48, "wings" 50 and 52, rigid ring 46, and bowstring channels 54. The cutouts 50 and "wings" 52 improve the aerodynamic performance of the peep sight and assist with dampening. FIG. 5B is a side perspective view of assembly 40, as oriented on its side. Shown are bowstring channels 54 and "wings" 52. FIG. 5C is a bottom or top perspective view of assembly 40. Shown are bowstring channel 54 and "wings" 52. FIG. 5D is a side perspective view of assembly 40, as oriented on its side, in a more flattened perspective that 5A. Shown are "wings" 52, rigid ring 46, cutouts 50, and sighting opening 48.

Opening 48 can be of any shape, including circular and oval shapes. In the case of an oval shape, the long axis of the oval may range from about 2 mm (0.78 inch) to about 13 mm (0.5 inch). In the case of a circle, the diameter of the circle may range from about 1 mm (0.04 inch) to about 10 mm (0.40 inch).

The overall dimensions of the assembly 40 are such the height of the assembly is between about 13 mm (0.5 inch) and 38 mm (1.5 inch); the depth of the assembly is between about 8 mm (0.3 inch) and 16 mm (0.6 inch); and the width of the assembly is between about 6 mm (0.25 inch) and 25 mm (1.0 inch).

The dimensions of channel 54 are in the range of 0.8 mm (0.03 inch) to 2 mm (0.08 inch) at its widest point; and its depth is in the range of 0.5 mm (0.02 inch) to 1.5 mm (0.06 inch).

The construction materials of the assembly are not limited to elastomeric rubbers and polypropylene polymers. For example, other materials than an elastomeric rubber, such as plastics and/or metals, may be used instead of the rubber comprising assembly 40.

Stabilizing devices that prevent rotation of assembly 40 on the bowstring (as the bowstring comes under tension during use) may be optionally attached to assembly 40, but are not required.

The attachment of assembly 40 to the bowstring is not limited to attachment between the strands of the bowstring.

Embodiments of the invention may be applied to any bow type or bowstring. Three exemplary types of bows are compound bows, recurve bows, crossbows and longbows.

During the process of shooting an arrow with a bow, the string is released from its potential energy state position. As it moves forward energy is transmitted from the bowstring to the arrow. When the arrow disengages from the bowstring there remains some kinetic energy in the bowstring and bow. This energy deforms the bow and thereby creates unwanted noise as the bow and bowstring system vibrate. The elastomeric material in the disclosed embodiments absorbs a portion of this energy because of its elastomeric and rheological properties. A typical durometer of the elastomeric rubber for constructing the embodiment disclosed could range from about 10 Shore A to about 70 Shore A.

An added benefit of the invention is the frictional resistance that occurs between the bowstring strands and the surfaces of the peep sight, in one example, side channels of the peep sight, that are elastomeric material (rubber). This elastomeric material minimizes the movement of the device within the string channels in assembly 40. It should be noted that any movement of the device would affect the targeting ability of the shooter, therefore minimal movement is desired.

Figure 6:
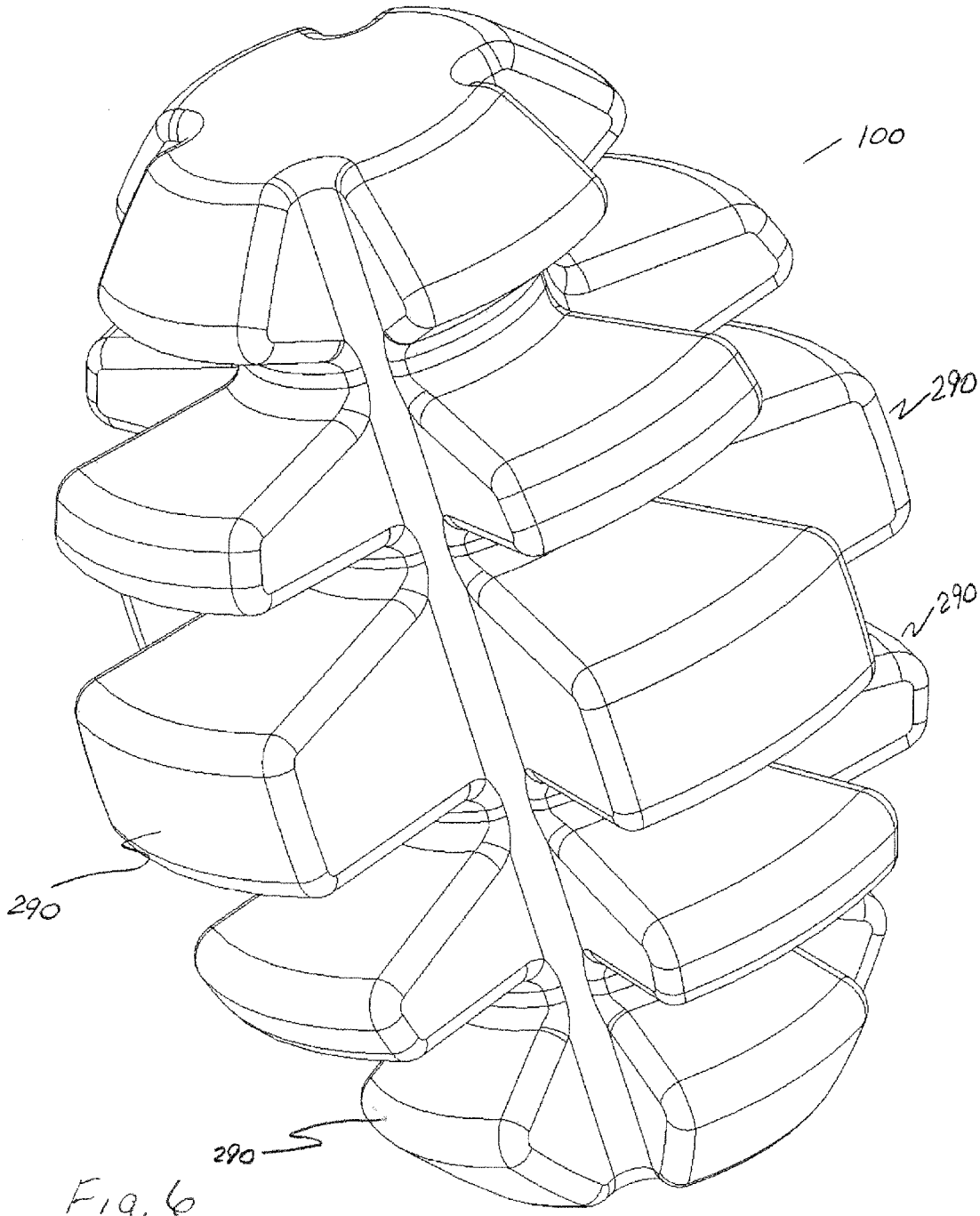
FIG. 6 is a perspective view of an embodiment of a bowstring dampener.

For archery bow configurations not requiring an integrated peep sight, such as a crossbow, embodiments providing the string silencing function alone are disclosed. In one such embodiment presented in FIG. 6, a string silencer 100 is shown that comprises a rigid inner core 200 that provides structure to the silencer and an over-molded outer portion 240 made of a less rigid elastomeric material.

Figure 7:
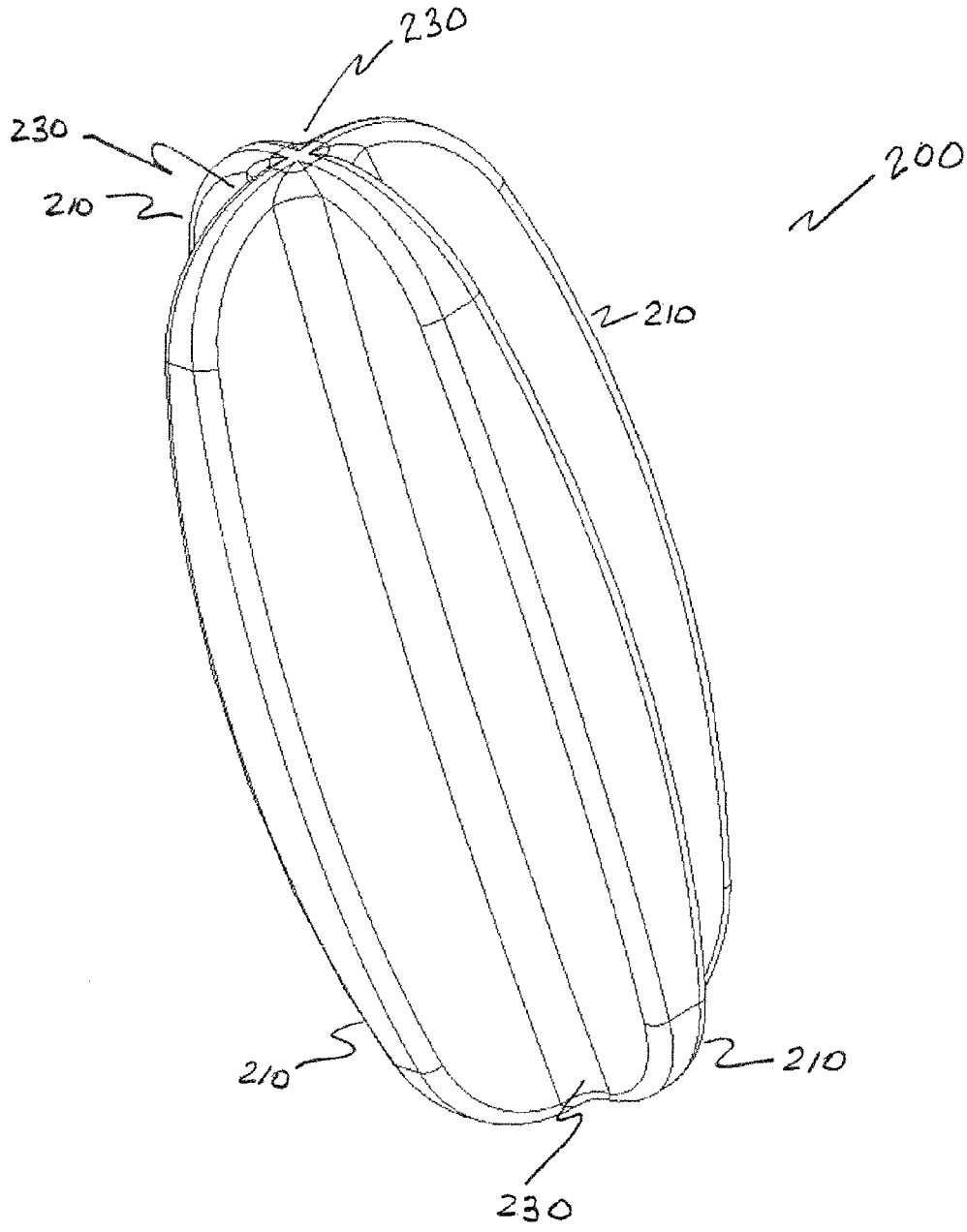
FIG. 7 is a perspective view of the inner core of the bowstring dampener of FIG. 6.
Figure 8:
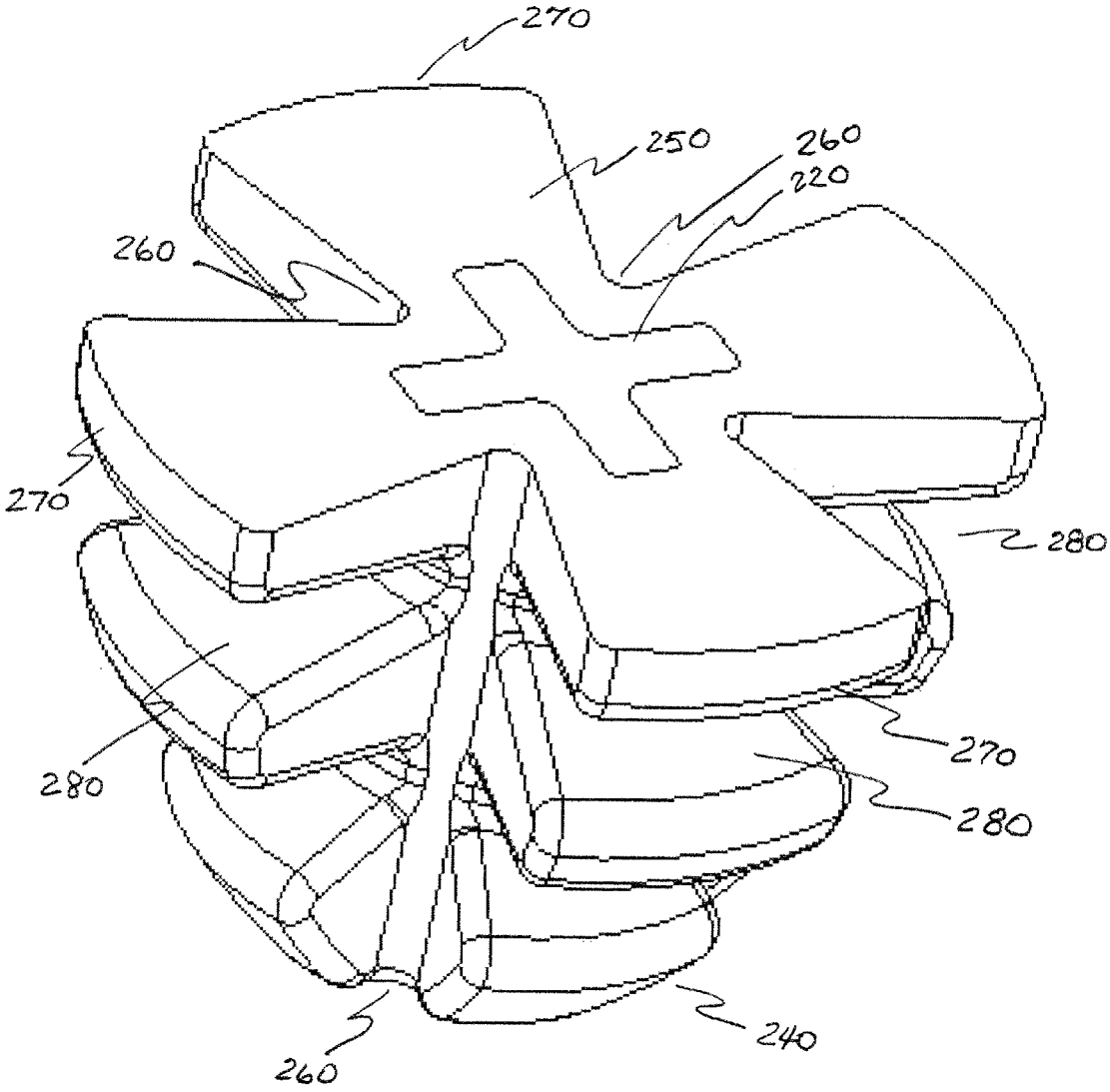
FIG. 8 is a perspective cutaway view of the outer portion of the bowstring dampener of FIG. 6.

In an embodiment shown in FIG. 7, the shape of the rigid inner core 200 is substantially ellipsoidal with a plurality of prominent longitudinal ribs 210. Other embodiments may have a non-ellipsoidal shape. For embodiments comprising four prominent longitudinal ribs 210, cross sections of the rigid inner core 220, as shown in FIG. 8, taken in planes perpendicular to the major axis of the ellipsoid may be substantially X shaped. For the representative materials utilized in this embodiment, the thickness of the cross shaped inner core should be a minimum of 0.015 inches to provide sufficient strength and rigidity. The thickness should not exceed 0.040 inches as this adds to the weight of the final assembly and can potentially slow the bow string. As shown in FIG. 7, the X shaped cross section 220 forms four channels 230 between each pair of ribs 210.

The outer portion 240 of the silencer has an interrupted cross-shaped cross-section 250. As is the case for the rigid inner core 200, the less-rigid outer portion 240 has four quadrants each comprising inner longitudinal interrupted channels 2 60, formed by four prominent longitudinal ribs 270, configured to receive four separate strand groups of a bowstring. In addition, latitudinal interruptions 280 of the longitudinal ribs 270 create a series of flexible nodules 290 that are configured to dissipate vibratory energy.

Other embodiments may depart from the ellipsoidal shape and may have greater or lesser than four longitudinal ribs.

The embodiment of the silencer may be manufactured by a two-stage process. In the first stage, the rigid inner core 200 is manufactured by a conventional molding process where a first heated material, having a hardness ranging between approximately 40 to 150 Rockwell R (when cooled), is injected into a first mold. A non-limiting exemplary first material is glass filled nylon. After cooling, the core 200 is removed from the first mold. The molded inner core 200 comprises a pair of circular contact points located at each end that are used to locate and suspend the inner core 200 in a second mold. The second mold has the outer shape geometry and is used to form the outer portion 240. After mounting the inner core 200 in the second mold, elastomeric material, preferably characterized by a durometer of between approximately 20 and 60 Shore A, is injected into the mold and allowed to cure. The elastomeric material, forming the outer portion 240, bonds to the inner core 200, as it is compatible with the rigid core material when heated to melting temperatures. The silencer is then removed from the second mold.

Figure 9:
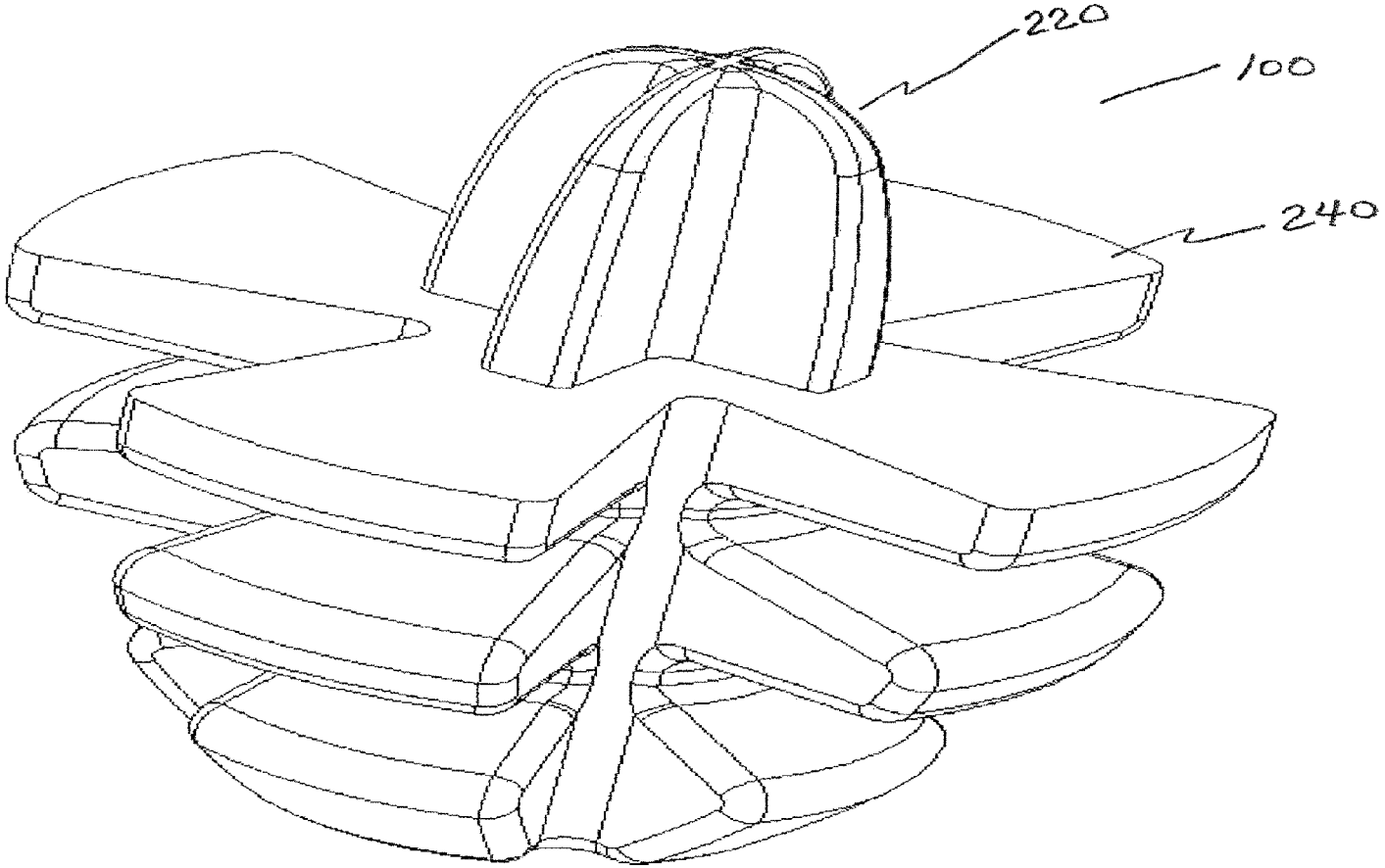
FIG. 9 is a perspective view showing the core mounted in a cutaway view of the outer prtion of the bowstring dampener of FIG. 6.

FIG. 9 shows a cutaway perspective view of the completed bowstring dampener embodiment 100 comprising the rigid inner core 200 mounted in the outer portion 240.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

STATEMENT REGARDING EMBODIMENTS

While the invention has been described with respect to embodiments, those skilled in the art will readily appreciate that various changes and/or modifications can be made to the invention without departing from the spirit or scope of the invention as defined by the appended claims. All documents cited herein are incorporated by reference herein where appropriate for teachings of additional or alternative details, features and/or technical background.

What is claimed is:

1. An archery bow string silencer comprising:

a rigid inner core portion, formed of a first material, that comprises a plurality of prominent inner longitudinal ribs;

a less-rigid outer portion, formed of a second material, bonded to said rigid inner core portion, said less-rigid outer portion comprising inner longitudinal channels, formed by a plurality of prominent outer longitudinal ribs, said prominent outer longitudinal ribs comprising latitudinal interruptions thereby forming multiple flexible nodules.

2. An archery bowstring silencer, in accordance with claim 1, wherein said rigid inner core has a substantially ellipsoidal shape.

3. An archery bowstring silencer, in accordance with claim 1, wherein said plurality is four.

4. An archery bowstring silencer, in accordance with claim 3, wherein cross sections of said rigid inner core portion, taken in planes perpendicular to the major axis of the ellipsoid, are substantially X shaped.

5. An archery bowstring silencer, in accordance with claim 1, wherein said first material has a hardness ranging between approximately 40 to 150 Rockwell R.

6. An archery bowstring silencer, in accordance with claim 5, wherein said first material is glass tilled nylon.

7. An archery bowstring silencer, in accordance with claim 1, wherein said second material is elastomeric.

8. An archery bowstring silencer, in accordance with claim 7, wherein said second material is characterized by a durometer of approximately 20 to 60 Shore A.

9. An archery bowstring silencer, in accordance with claim 1, wherein thickness of said rigid inner core portion is between approximately 0.015 inches and 0.040 inches.

* * * * *